US005900815A

United States Patent [19]

Story

[11] Patent Number: 5,900,815

[45] Date of Patent: May 4, 1999

[54] GATE ALARM SYSTEM

[76] Inventor: Benny C. Story, 216 E. Prosperity Ave., Tulare, Calif. 93274

[21] Appl. No.: 08/870,748

[22] Filed: Jun. 6, 1997

[51] Int. Cl.[6] ..... G08B 13/08

[52] U.S. Cl. ..... 340/548; 49/13; 340/540; 340/545.1; 340/691.1

[58] Field of Search ..... 340/548, 545, 340/691, 540, 522; 49/13

[56] References Cited

U.S. PATENT DOCUMENTS

| | | | |
|---|---|---|---|
| D. 297,170 | 8/1988 | Elliott | D26/24 |
| D. 355,273 | 2/1995 | Steddom | D26/66 |
| 4,005,397 | 1/1977 | Blair | 340/526 |
| 4,186,362 | 1/1980 | Kondo et al. | 335/205 |
| 4,258,358 | 3/1981 | Lee et al. | 340/543 |
| 4,272,039 | 6/1981 | Hollingsworth | 244/1 R |
| 4,340,884 | 7/1982 | Maizland | 340/548 |
| 4,688,022 | 8/1987 | Gray | 340/540 |
| 4,776,530 | 10/1988 | Mansfield | 244/1 R |
| 4,829,287 | 5/1989 | Kerr et al. | 340/541 |
| 4,931,772 | 6/1990 | Bechtold | 340/573 |
| 5,007,661 | 4/1991 | Lenzen | 280/735 |
| 5,122,782 | 6/1992 | Kawahara | 340/540 |
| 5,128,591 | 7/1992 | Bocan | 315/241 S |
| 5,332,992 | 7/1994 | Woods | 340/547 |
| 5,406,254 | 4/1995 | Le Nay et al. | 340/501 |
| 5,438,316 | 8/1995 | Motsinger et al. | 340/541 |
| 5,548,275 | 8/1996 | Shambayati et al. | 340/573 |
| 5,578,990 | 11/1996 | Sanford, Jr. et al. | 340/541 |

*Primary Examiner*—Glen Swann
*Attorney, Agent, or Firm*—Coudert Brothers

[57] ABSTRACT

A gate alarm system includes a gate of a wire or cable between supports, a gate entry and a gate alarm comprising a gate alarm housing, a switch, a switch activating device, a spring or coiled wire for biasing the switch activating device, an alarm, and a power source for the alarm. The switch activating device is maintained under compression by the spring or coiled wire during the gate closed mode and contacts the switch and sets off the alarm in the gate open mode when this compression is relaxed. The gate entry can range from a handle, a clasp and a loop to a handle, a combination of a threaded rod and tube, a clasp and loop. This very simple alarm system warns of unauthorized entrance to parking lots of commercial establishments, driveways to private dwellings, and roads or cart paths to farms and ranches; and to alert personnel of open gates in enclosures around unsafe areas such as wells or in construction and demolition sites.

39 Claims, 7 Drawing Sheets

GATE ALARM SYSTEM

FIELD OF THE INVENTION

This invention relates generally to the field of alarm systems for signaling when a gate or movable barrier is in use. In particular, this invention is directed to a simple gate alarm system for signaling when a gate without a latch is opened and any unauthorized entry is attempted.

BACKGROUND OF THE INVENTION

Elaborate alarm switches have been developed over the years, but they are much too complex and are not practical for numerous situations and environments. U.S. Pat. Nos. 4,258,358 and 5,332,992 disclose and claim just two of numerous security alarm systems. Such systems are usually mounted on or within stationary doors or window frames of finished structures and require electrical leads from the switch to the alarm control box. U.S. Pat. No. 5,332,992 discloses and claims an alarm switch assembly for a door or window. Another category of alarm systems are those that detect forced entry at any section of fencing between vertical posts; see U.S. Pat. Nos. 4,005,397; 4,829,287 and 5,438,316. None of these patents address the problem of entry through a gate.

There is a need for a non-complex system for signaling the unauthorized entry through a gate or other movable barrier that does not have a latch. A few examples of numerous situations where there is a need for such a non-complex system include a gate in a farm or ranch fence, a gate in commercial and residential fencing and a gate to protect personnel from hazardous areas, e.g. construction and demolition sites, mine shafts and the like.

SUMMARY OF THE INVENTION

The gate alarm system of the present invention broadly includes a gate, a gate entry means and a gate alarm means comprising a gate alarm housing, a switch, a switch activating means, a biasing means for biasing the switch activating means toward the switch during the gate open position and away from the switch during the gate closed position, an alarm means, and a power source for the alarm means.

The present invention has the advantage of providing a simple and inexpensive solution to a gate alarm system in the following two major categories:

(1) to warn of unauthorized entry to parking lots of commercial establishments, to foot paths and driveways of private dwellings, and to roads, foot paths or cart paths to farms and ranches; and (2) to alert personnel of open gates in enclosures around unsafe areas, e.g., construction and demolition sites, wells, mine shafts and the like.

The alarm means for a typical gate alarm system in category (1) applications includes either a siren or a combination of a siren and a flashing light. In most category (1) applications, a key lock or key pad is typically used to deactivate the alarm prior to an authorized entrance. On the other hand, the noise level in a typical construction or demolition site of category (2) applications is so high that the use of a siren alone is insufficient. Therefore, the primary means for alerting personnel of an open gate in the alarm system of the present invention is a flashing light or strobe light or a combination of the light and a siren.

A gate is defined for both categories of the present invention to mean a movable length of a least a strand of metal wire for closing an opening or for preventing access through an opening between a pair of supports. Gates that meet this definition are commonly used to control access by vehicles and other equipment, supplies, personnel, and animals through a fence, a wall or other enclosure, or between a fence and a wall or other enclosure. A single strand of wire of a large enough diameter, i.e., at least about ⅛ inch, can be used as the gate in the gate alarm system of the present invention. In most applications however, a gate for the present invention comprises a plurality of fine, i.e. less than ⅛ inch, wire strands intertwined or interwoven to form a cable placed between two supports. Steel cable having a diameter of at least ¼ inch, can be effectively used in most applications. Steel can be replaced by other metals having similar tensile strength. In its simplest form, the gate for categories (1) and (2) is formed by attaching each end of the wire or cable, that is generally parallel to a planar surface or work platform, between the supports extending generally perpendicular to the planar surface or platform. Fencing can be attached to the generally horizontal wire or cable between the supports to prevent someone from stooping under the wire or cable to gain unauthorized entry.

In the broadest embodiment of the present invention, the gate entry means for opening the gate can be a hook and eye or clasp and loop latching device operably attached to the gate between the two supports. Generally, the hook or clasp is mounted on an end of the wire or cable. Correspondingly, the eye or loop is mounted on either end of the wire or cable or on one of the supports so that the eye or loop is connectable to the hook or clasp. Because the latching devices for the two application categories of the present invention do not have a standard latch that slides into a catch or groove of a jamb, the types of security alarms that are currently on the market often cannot be used.

In the present invention, the gate alarm means includes the gate alarm housing mounted on a first support, an on/off switch and the switch activating means comprising a switch activating plate, a shaft having a first shaft end fixedly attached to the switch activating plate and a second shaft end extending through a wall in the housing and connected or connectable to a first gate end, and a biasing means between the switch activating plate and the inner surface of the housing wall adjacent to the first gate end. The first shaft end and the switch activating plate can be integrally combined as one piece. In the gate closed position, sufficient compression is applied to the biasing means in a lateral direction away from the switch to prevent the switch activating plate from engaging a push button of the on/off switch and to prevent activating the alarm means. When the clasp on the gate is unhooked from the loop, the biasing means laterally moves the plate to activate the switch into the open gate alarm position because the tension on the wire or cable is reduced and hence the compression on the biasing means is relaxed.

In the broadest embodiment, the gate entry means is adjacent to the first support and includes (1) the loop connected to or integrally formed in the second shaft end that extends through the wall of the gate alarm means housing and (2) the clasp connected to a loop attached to or integrally formed in the first gate end. The portion of the second shaft end forms a handle. To open the gate, sufficient compressive force is applied on the biasing means using this handle to allow clearance to release the clasp. When the clasp is released, the biasing means then goes into the relaxed, gate open position to activate the alarm. If the purpose of the gate alarm system is to alert personnel that the gate is open, the alarm means can be a visual alarm such as a light, preferably a flashing light or strobe light alarm. If the purpose of the gate alarm system is for security to prevent unauthorized personnel from opening the gate to drive vehicles or to move equipment, farm animals and the like through, the alarm means is either an audible alarm or a combination of the audible alarm and a visual alarm. In that case, a key lock or key pad is usually electrically connected to the switch/alarm circuit to deactivate the alarm before the gate is opened by authorized personnel.

It has been found that if the compressive force on the biasing means, such as a coiled wired or spring, is greater than about 50 pounds of compressive force for a compression of about ¾ inch, the average user will not be able to unhook the clasp from the loop to open the gate and correspondingly, to hook the clasp to the loop to close the gate. Therefore, the gate entry means preferably uses the principal of the simplest of machines, e.g., the threading and unthreading of a screw, bolt or threaded rod, to overcome such compressive forces greater than about 50 pounds. Specifically in the preferred embodiment of the present invention, the gate entry means comprises an enclosure, a threaded rod extending through one end of the enclosure, and a hollow tube extending through the other end of the enclosure end and a threaded interior for receiving the portion of the threaded rod within the enclosure. A handle, knob or other suitable means is connected to the end of the tube extending from the enclosure for unthreading a portion of the tube from the rod. Once a small portion of the tube is unthreaded from the rod, the compression of the coiled wire is sufficiently relaxed to permit clearance to unhook the clasp from the loop. This in turn, causes the switch activating plate to forcefully move in a lateral direction against the on/off button of the switch to activate the alarm the instant the compressed coiled wire or spring is relaxed.

DETAILED DESCRIPTION OF THE EMBODIMENTS OF THE PRESENT INVENTION

Figure 1:
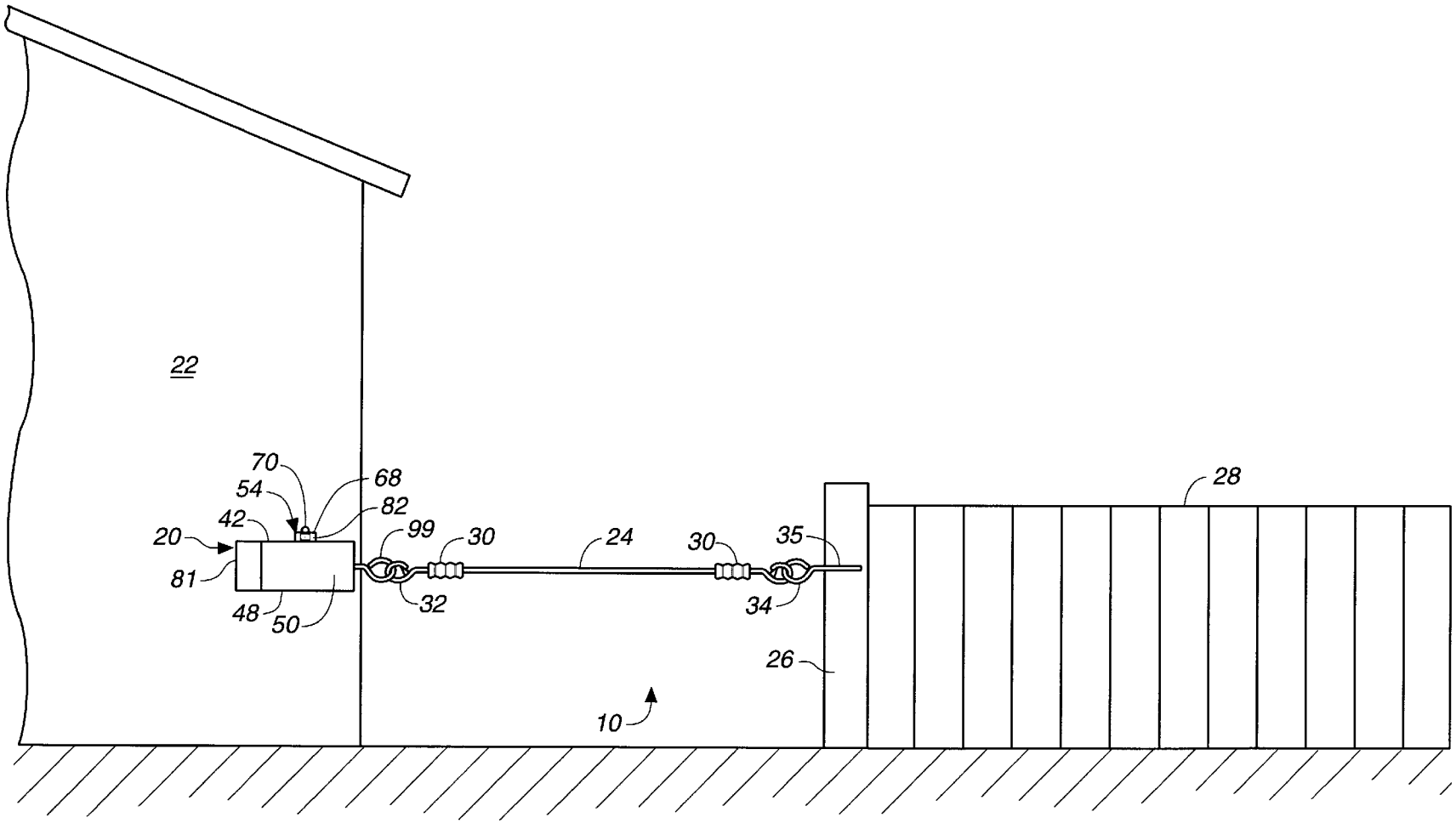
FIG. 1 is a diagrammatic view of one embodiment of the gate alarm system of the present invention.
Figure 2A:
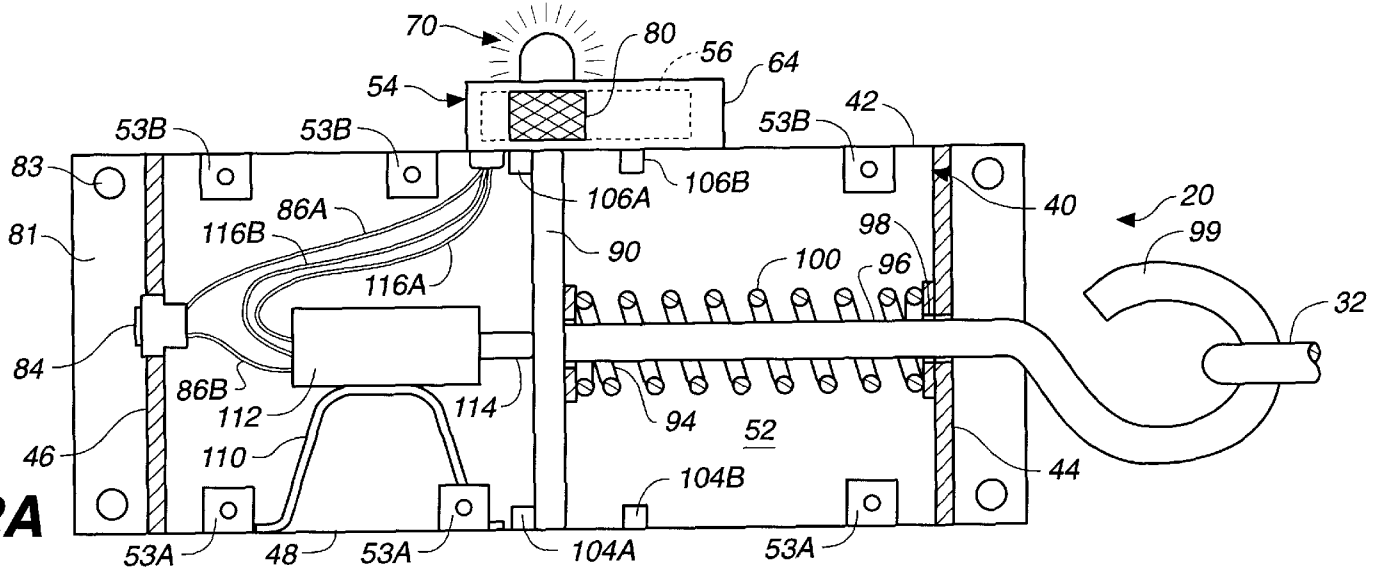
FIG. 2A is a side view, partially in cross-section, of the gate alarm means of the alarm system of the present invention in its gate open mode.
Figure 2B:
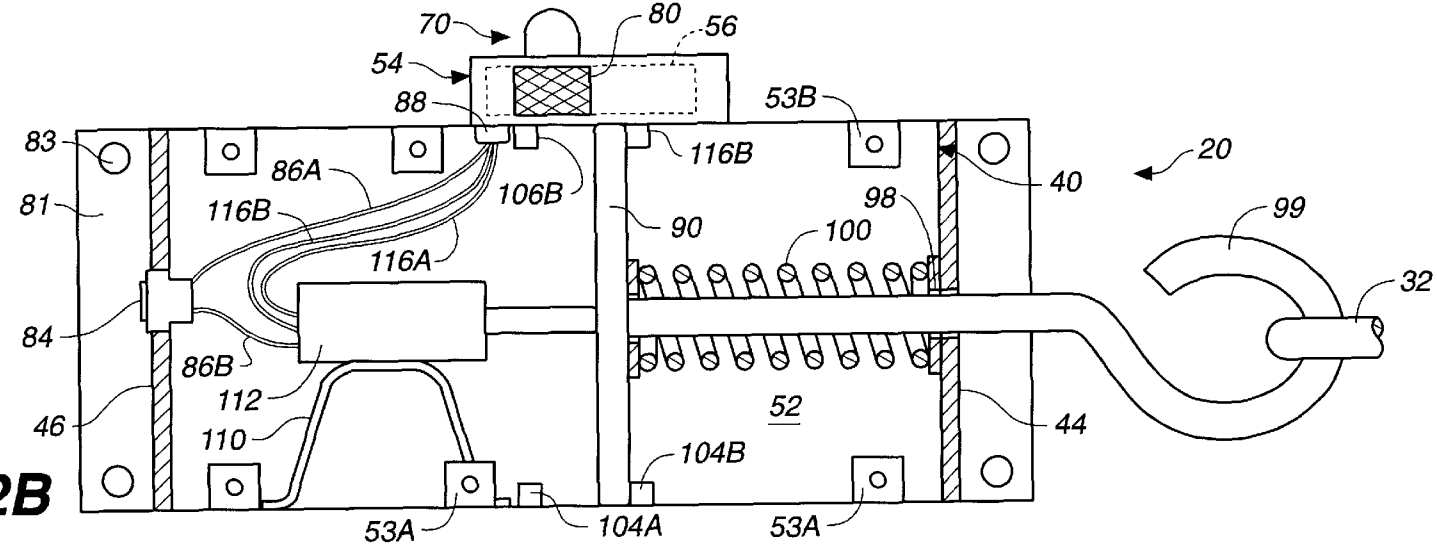
FIG. 2B is a side view, partially in cross-section, of the gate alarm means of the gate alarm system of the present invention in its gate closed mode.

One embodiment of the gate alarm system 10 of the present invention is shown in FIGS. 1, 2A and 2B and includes gate alarm device 20 on support structure 22, gate 24 mounted between support structure 22 and upright support 26 of fence 28 and gate entry means. The gate entry means comprises clasps 30 respectfully connected to eye looped end 34 of shaft 35 attached to upright support 26 and to eye looped end 32.

Unless otherwise specified below, all the materials of construction used in the manufacture of the elements of the gate alarm system 10 described below were case hardened steel and were chosen to prevent their being tampering with. Gate alarm device 20 included housing 40 having the approximate outer dimensions of about 10½ inches long, about 4 inches high and about 2¾ inches wide, having top 42, housing first end 44, housing second end 46, bottom 48, front wall 50, and rear wall 52. Front wall 50 was removably fastened to three flanges 53A and 53B with bolts (not shown). Pairs of flanges 53A and 53B were respectively welded on bottom 48 and top 42 as shown in FIG. 2A. The wall thickness of each of the walls of housing 40 was about ⅛ inch except first end 44, which was about ½ inch thick to accommodate the gate alarm means discussed below.

Battery case 54 for enclosing battery 56 was attached to top 42 with a tab (not shown) welded to each side 64 of battery case 54 and bolted to top 42. Case 54 had a height of 5 inches, a width of 2¾ inches and a length of 4 inches and contained a 12 volt rechargeable lead acid battery, Catalog No. 23-289 specifically sold by Radio Shack for alarm control centers. A circular plate (not shown) having a diameter of 4¾ inches was welded to top 68 of battery case 54 having a bore (not shown) with a diameter of ½ inch for the electrical leads from battery 56 to the alarm means consisting of the combination of strobe light 70 and siren/strobe light 80. Security strobe light 70, Catalog No. 39-457 sold by Radio Shack, was attached to the plate with screws and electrically connected to battery 56 by the leads through the bore in the plate. Security siren/strobe light 80, Catalog No. 49-478 sold by Radio Shack, was bolted to side 82 of battery case 54 and electrically connected to the battery. Bracket 81 can be put on any position to fit on housing 40. In one prototype, bracket 81 was welded to housing second end 46 having bolt holes 83 for attaching housing 40 to support structure 22. Key lock or combination switch 84 electrically connected via lead 86A to the battery through channel 88 in housing top 42 and via lead 86B can be added to housing second end 46 to allow personnel with the appropriate key or combination to enter through gate 24 without setting off the alarm means.

Switch activating plate 90 was provided having a width of about 2½ inches, a height of about 3½ inches and a thickness of about ⅜ inch with a threaded bore in its center. End 94 of shaft 96 was threaded into bore 92. Preferably, end 94 was welded to the plate 90. Shaft 96, having a diameter of about ⅝ inch, extended about 4¼ inches through the right approximate one third of the about 10 inch longitudinal length of interior of housing 40 to eye looped end 99 connected to looped end 32 of gate 24. The total length of shaft 96 from end 94 to looped end 99 was about 7 inches. Coiled spring 100 having a diameter of about 3/16 inch and a relaxed span of 4⅛ inches encircled shaft 96 within housing 40 and was biased between switch activating plate 90 and first end 44. A pair of stops 104A and 104B were welded to bottom 48 and a pair of stops 106A and 106B were welded on top 42 on either side of plate 90 to allow lateral travel of about ¾ inch for plate 90 within housing 40. The ¾ inch travel caused spring 100 to reach its maximum compression with a span of about 3⅜ inches. This requires about 10 pounds of compressive force for each ⅛ inch of travel and approximately 80–90 pounds of total compressive force to achieve maximum compression. It was found that by reducing the diameter of the coiled spring to about ⅛ inch, the total compressive force required to reach maximum compression is in the range of about 40 or 50 pounds of compressive force.

Switch support 10 was welded to a wall of housing 40 approximately in the middle of the left two thirds of the longitudinal length of interior of housing 40. Microswitch 112 having a part number of BZ-7RQ77T was bolted to switch support 110 and was connected to a 12 volt rechargeable lead acid DC battery 56 by leads 116A and 116B. Switch 112 was positioned on support 110 so that when on/off shaft or push button 114 was immediately adjacent to plate 90 in the gate closed mode, spring 100 was at maximum compression. When spring 100 was in the gate open position, plate 90 was pressed against on/off push button 114 to activate the alarm means and urged against stops 104A and 106A which prevented plate 90 from applying harmful pressure on switch 112.

For some applications, spring 100 can be replaced by a spring or other biasing means having a compressive force of less than 50 pounds as described above. In such applications, looped end 99 is connected to looped end 32 of gate 24 with gate entry clasp 30 to serve as the gate entry means. Stops 104B and 106B can be omitted and spring 100 would not be in maximum compression in the gate closed position. Looped end 99 would serve as a handle to further compress spring 100 to allow sufficient clearance to unhook clasp 30 and thereafter allow spring 100 to force plate 90 to activate push button 114.

Figure 3A:
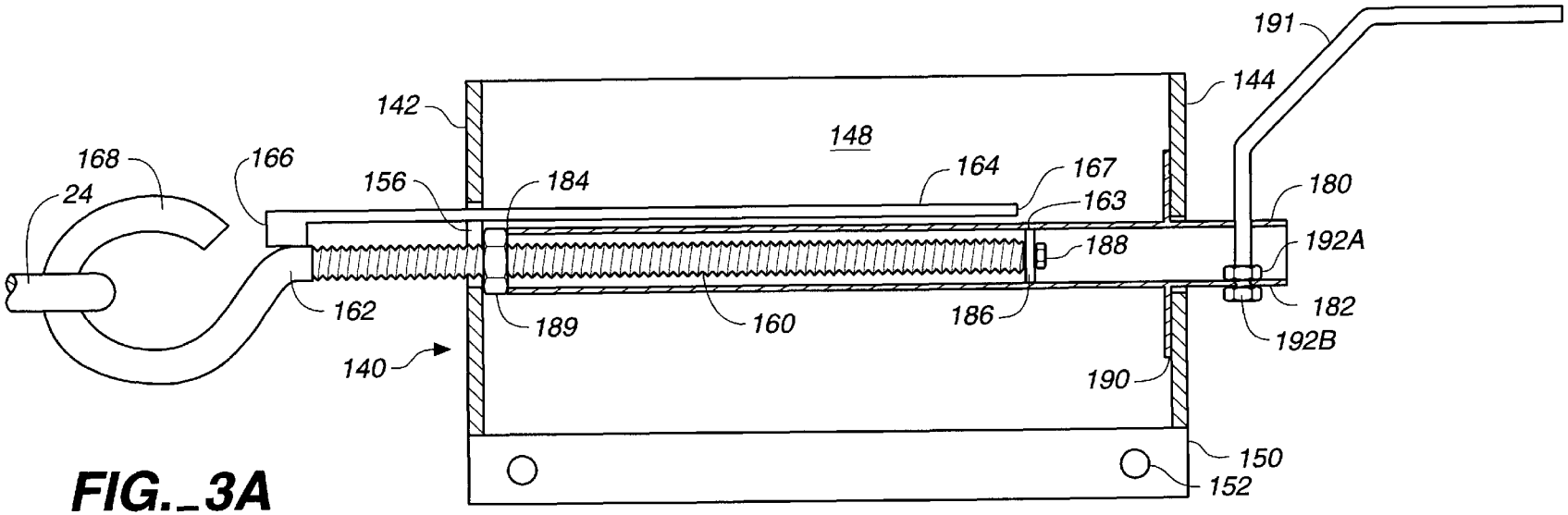
FIG. 3A is a side view, partially in cross-section, of the preferred embodiment of the gate entry means of the present invention in its gate open mode.
Figure 3B:
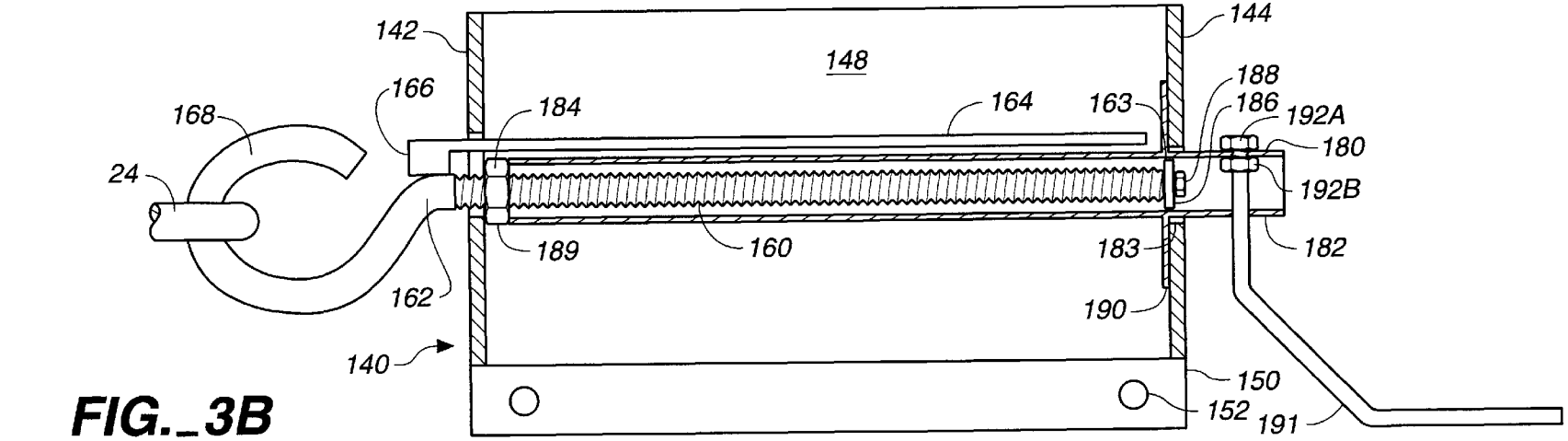
FIG. 3B is a side view, partially in cross-section, of the preferred embodiment of the gate entry means of the present invention in its gate closed mode.
Figure 4A:
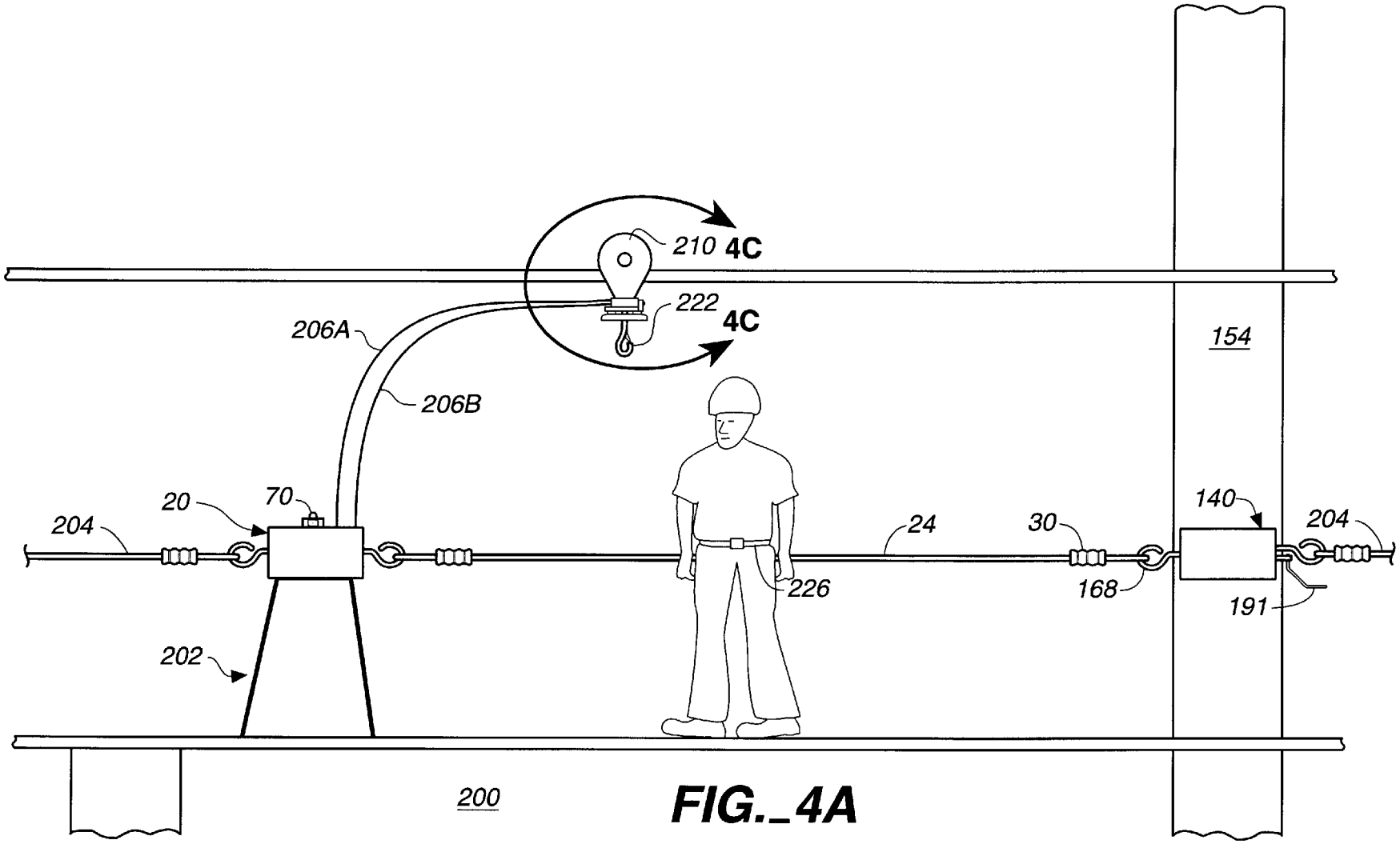
FIG. 4A is a diagrammic view of a preferred embodiment of the gate alarm system of the present invention in the gate closed position.
Figure 4B:
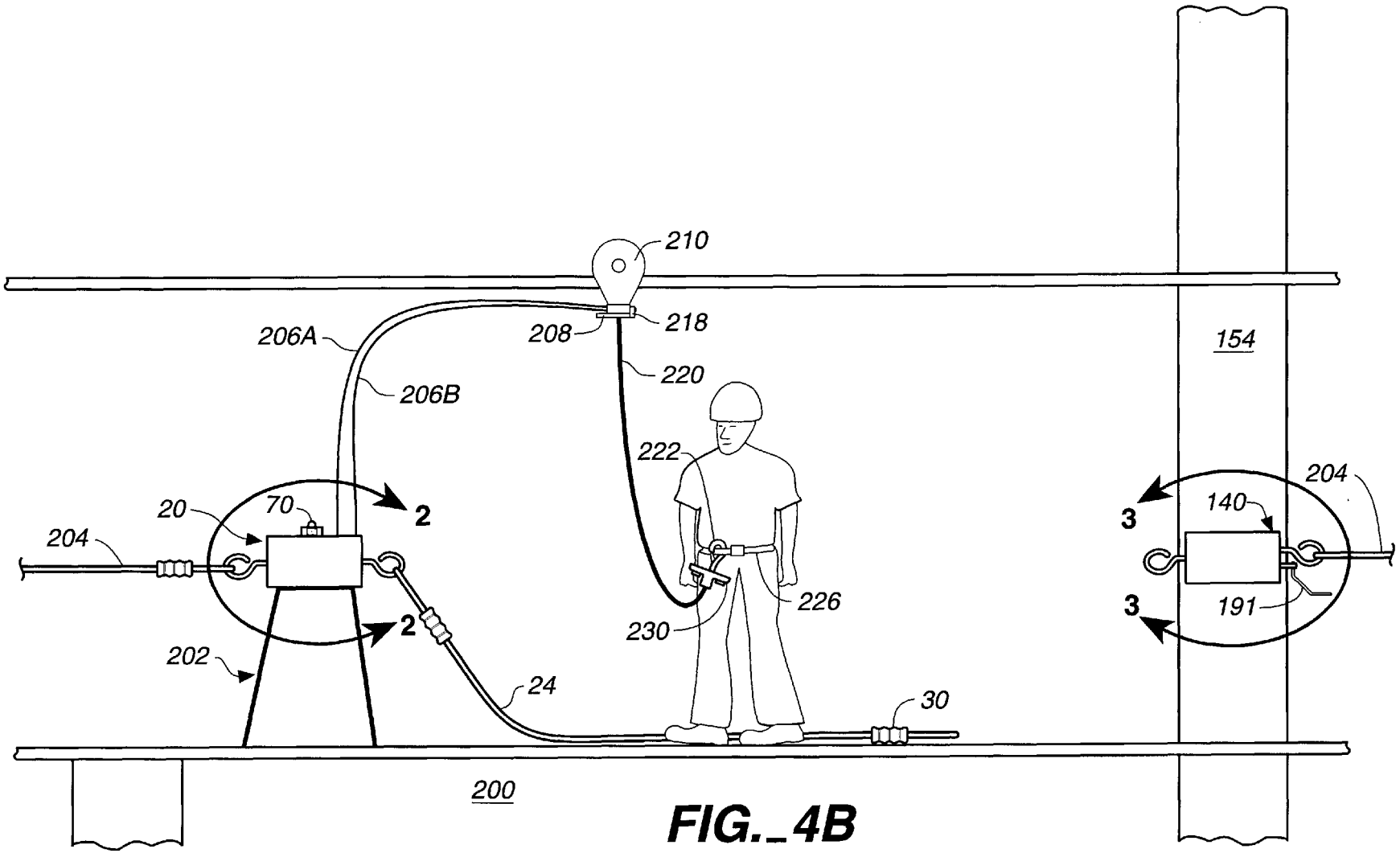
FIG. 4B is a diagrammic view of a preferred embodiment of the gate alarm system of the present invention in the gate open position.

In most applications of the alarm system of the present invention, spring 100 possesses sufficient compressive strength so that one individual would not be able to unhook clasp 30. Another spring (not shown) with less than 50 pounds of compressive force can be connected to gate 24 along its length between upright support 26 and looped end 32. In a preferred embodiment, the gate entry means has the dual function of relaxing spring 100 during the open gate mode and compressing spring 100 during the gate closed mode. A prototype of a gate entry means as shown in FIGS. 3A and 3B, consisted of gate entry enclosure 140 having substantially the same approximate outer dimensions as housing 40, e.g., about 10½ inches long, about 4 inches high and about 2¾ inches wide. Enclosure 140 had enclosure end 142 adjacent to gate 24, enclosure end 144, rear wall 148 and a front (not shown). Bracket 150 was welded to rear wall 148 having bolt holes 152 for attaching enclosure 140 to members (not shown) attached to upright support column 154 (FIG. 4A). Enclosure end 142 had keyhole 156 consisting of a 13/16 inch hole with a 5/16 slot. Enclosure end 144 had a bore with a diameter of 1⅛ inch. Threaded coil rod 160 had a diameter of ¾ inch and a length of 9 inches from threaded rod end 162 to rod end 163. Rod 160 was extendable through the 13/16 hole of keyhole 156 and substantially the entire length of enclosure 140 to enclosure end 144. Bar 164 had a cross-section of ¼ inch and a length of about 9 inches from bar end 166 welded to rod end 162 to bar end 167 adjacent rod end 163 during the gate closed position shown in FIG. 3B. Bar 164 was parallel to and extendable with rod 160 and passed through the slot of keyhole 156. Gate 24 was removably connected to loop 168 with clamp or clasp 30. Looped end 168 was formed from a ½ inch rod and had a width of 2½ inches and a length of 3 inches. Pipe or tube 180 had a diameter of ¾ inch and a length of about 10 inches from pipe end 182 to pipe end 184. Pipe 180 extended through bore 183 in enclosure end 144. Washer 186 was attached with nut 188 to rod end 163 within pipe 180 to prevent rod 160 becoming disengaged from pipe 180. Nut 189 was welded to pipe end 184 within enclosure 140 adjacent to enclosure end 142 to serve as the threaded portion of pipe 182. Flange 190 was welded to pipe 180 to prevent pipe 180 from laterally traveling out of housing 140. Handle 191 for rotating pipe 180 was formed of a ½ inch by 10 inch bolt threaded through pipe end 182 and had nuts 192A and 192B sandwiching the wall of pipe 180. Handle 191 was rotated counterclockwise until a portion of rod 160 was threaded through nut 189 to provide sufficient slack in clasp 30 to open gate 24. In this position, spring 100 was in its relaxed state in the gate open mode. Specifically, handle 191 was rotated counterclockwise about 7 turns to cause rod 160 to move along threaded rod 160 for a lateral distance of about ¾ inch giving sufficient clearance to unhook clasp 30 to open gate 24. As stated above, spring 100 travels ¾ inch from maximum compression to a fully relaxed position.

Figure 4C:
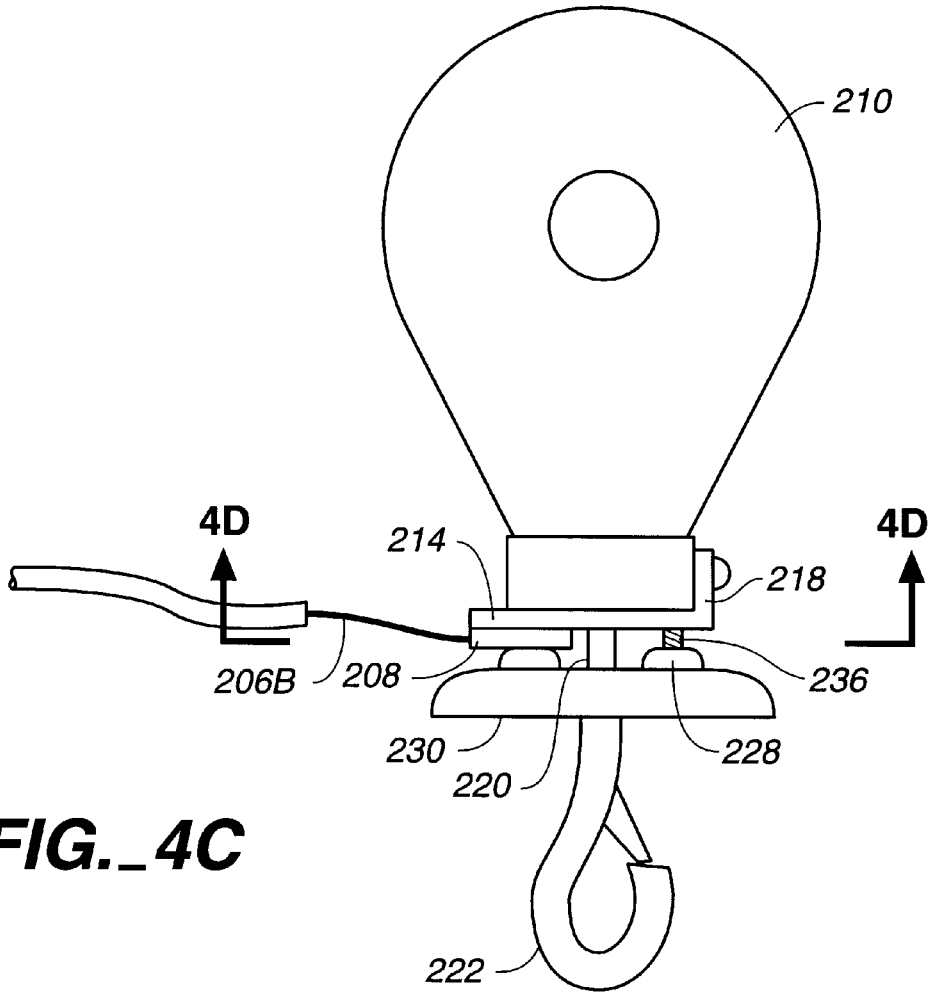
FIG. 4C is a diagrammic view of the magnetic plate and magnetic switch shown in FIGS. 4A and 4B together with the cable retractor along line 4C—4C.
Figure 4D:
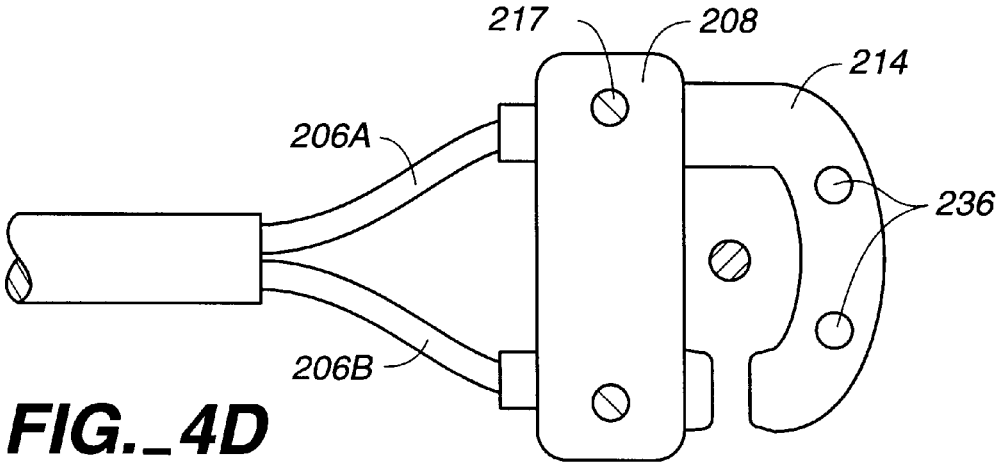
FIG. 4D is a side view of the magnetic plate and magnetic switch shown in FIGS. 4A and 4B and taken along line 4D—4D.

Construction gate alarm system 200 is shown in FIGS. 4A, 4B, 4C and 4D and includes construction gate alarm device 20 on a temporary upright structure 202, gate 24 mounted between upright structure 202 and upright support column 154 of protective cable system 204 of a building under construction, clasp 30 and a gate entry means. Construction gate alarm device 20 is substantially the same as that described above in connection with the discussion of FIGS. 1, 2A and 2B except for the electrical connection leads 206A and 206B from normally closed magnetic contact switch 208, Catalog No. 49-532 sold by Radio Shack, attached to cable retractor 210. One suitable cable retractor that has been used with the alarm system of the preferred embodiment was purchased from Miller Equipment Company, Catalog No. M55-25G. Magnetic switch 208 was first cemented to one end of attaching bracket 214 with layer of silicone caulking compound and a pair of screws 217. Tabs 218 on bracket 214 were used to bolt bracket 214 to cable retractor 210 as shown in FIG. 4C.

In operation of alarm system 200, an individual shown in phantom pulls down on safety cable 220 and connects clasp 222 to safety harness 226. By pulling down on safety cable 220, the individual breaks the magnetic attraction between a plurality of magnets 228 that had been glued or otherwise cemented to circular plate 230 having a central opening (not shown) encircling safety cable 220 as shown in FIG. 4C. Rubber grommets 236 were mounted on the end of attaching bracket 214 to equalize the difference in height of magnetic switch 208 and to assure that magnets 228 make good contact with magnetic switch 208. Circular plate 230 was fixedly attached to safety cable 220 with fasteners (not shown). Magnetic switch 208 is normally closed and in parallel with strobe light 70. Breaking the magnetic attraction between magnets 228 and magnetic switch 208 causes switch 208 to open and prevents strobe light/siren 80 from becoming activated. After the individual opens gate 24 by about a half dozen rotations of handle 191 as discussed above, strobe light 70 flashes indicating the gate open mode. However, because magnetic switch 208 is open, strobe light/siren 80 remains silent.

Referring now to FIGS. 5A–5E, five exemplary electrical circuits for the gate alarm system of the present invention are shown. It is apparent that one skilled in the art can use the teachings of the present invention to arrive at other electrical circuits to achieve various combinations of alarms.

Figure 5A:
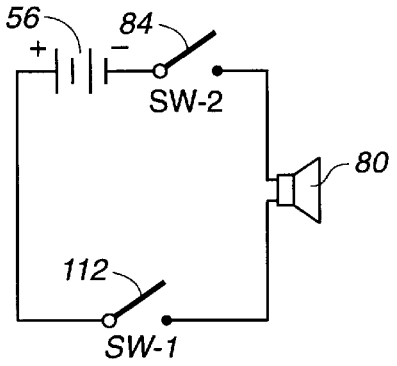
FIGS. 5A–5E are schematic diagrams of various exemplary electrical circuits for the gate alarm system of the present invention.

FIG. 5A shows a circuit of a DC power source connected in series to switch SW-1, switch SW-2 and siren 80, where switch SW-1 is equivalent to the switch 112 described above and switch SW-2 is equivalent to the key or combination switch 84. The FIG. 5A electrical circuit is described above in detail in connection with a description of FIGS. 2A and 2B except for the elimination of light 70. In this embodiment to cover a category (1) application to warn of unauthorized entry, the siren is activated the instant the gate is opened and someone with a key or the combination has not disarmed SW-2 to permit authorized entry.

Figure 5B:
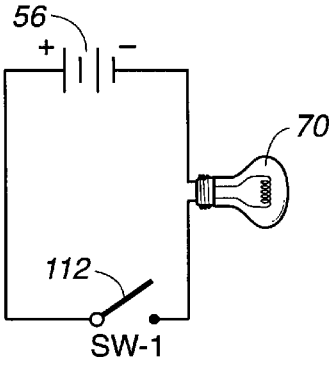

FIG. 5B shows a circuit of a DC power source connected in series to switch SW-1 and light 70. This embodiment can be used in category (2) applications when one needs a visual alarm indicating the gate is open. This embodiment is similar to that described in connection with FIGS. 4A and 4B except for the elimination of magnetic switch 208.

Figure 5C:
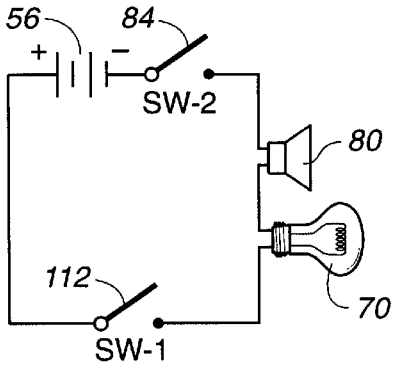

FIG. 5C shows a circuit of a DC power source connected in series to switch SW-1, switch SW-2, light 70 and siren 80. This circuit is described above in connection with FIGS. 2A and 2B.

Figure 5D:
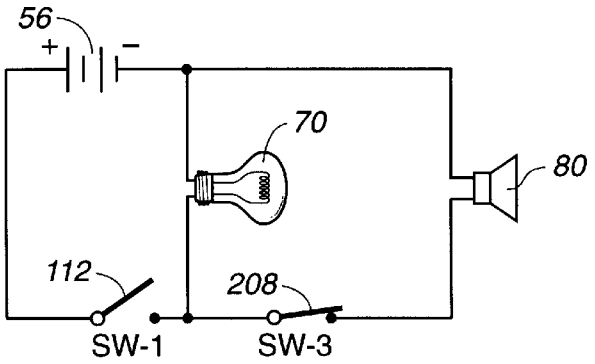

FIG. 5D shows a circuit of a DC power source connected in series to switch SW-1 and light 70 and the power source connected in parallel to switch SW-3 and siren 80, where SW-3 is magnetic switch 208. The latter electrical circuit is described in detail in connection with the above description of FIGS. 4A, 4B, 4C and 4D. In this preferred embodiment to cover construction site or destruction site gate applications, switch SW-1 is activated the instant the gate is opened, but siren 80 remains off unless someone fails to pull down on safety cable 220 and connect clasp 222 on safety harness or belt 226. Contractors and other supervisory personnel in charge of the construction or destruction of a building or other structures have found by installing gate alarm system 200 of the preferred embodiment, they are alerted when gate 24 is open by visual alarm 70 and are then attuned to listen for siren 80. If siren 80 is activated, they are aware that a person has opened gate 24 and has not properly used safety cable 220 which is required during all times that gate 24 is open. Prior to the installation of the simple alarm system of the present invention, construction workers had a habit of opening a construction gate without connecting the safety harness. Consequently a number of lost time injuries occurred because a certain percent of the unsafe workers would accidentally fall to the platform below while loading equipment and material adjacent the open gate. The act of pulling the safety cable down and connecting it to the safety harness was believed by such workers to take more time than they felt it was worth. Since the installation of alarm system of the preferred embodiment of this invention, no injuries have occurred as a result of falls from the platform through an open gate.

Figure 5E:
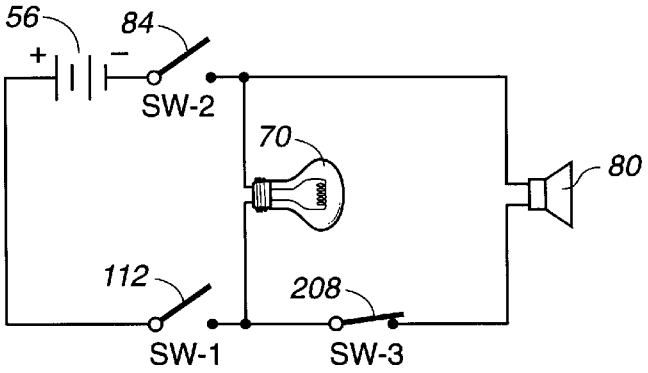

FIG. 5E is a variation of the electrical circuit shown in FIG. 5D except for the addition switch SW-2 in series with the DC power source and switch SW-1. This circuit allows authorized personal to deactivate the entire alarm system. Such a circuit would be useful in category (1) applications where one can either have the security light activated when the gate is open by unauthorized personal without the siren being activated or have both the light and the siren activated when the gate is open by unauthorized personal or the combination of both alarms.

One of ordinary skill in the art can make the foregoing modifications and many other changes and modifications to the gate alarm system of the present invention to adapt it to specific usages and conditions. As such, these changes and modifications are properly, equitably, and intended to be, within the full range of equivalents of the following claims.

What is claimed is:

1. A gate alarm system which comprises:

(a) a gate to protect personnel from falling from a work platform comprising a cable having a first gate end adjacent to a first support and a second gate end adjacent to a second support and extending generally between said first support and said second support during a gate closed position, at least a portion of said cable capable of being positioned to a gate open position and capable of being returned to the gate closed position;

(b) a gate alarm means comprising:

(i) a gate alarm housing mounted to said first support;

(ii) a switch within said gate alarm housing;

(iii) a switch activating means within said gate alarm housing for activating said switch;

(iv) a biasing means for biasing said switch activating means toward said switch during the gate open position;

(v) an alarm means operably mounted to said gate alarm housing and electrically connected to said switch for signaling when said gate is in the gate open position; and (vi) a power source for said alarm means and electrically connected to said switch; and (c) gate entry means on said gate for establishing a gate open position to allow biasing said switch activating means towards said switch and thereby activating said switch.

2. The gate alarm system of claim 1 wherein said housing has a first housing end adjacent to said first gate end, and a second housing end, a pair of sides, a top and a bottom, wherein said switch activating means comprises a switch activating plate, a shaft horizontally extending through said first housing end having a first shaft end connected to said first gate end and a second shaft end attached to said switch activating plate, and wherein said biasing means is a coiled spring encircling said shaft between said switch activating plate and said first housing end for laterally moving said plate within said housing.

3. The gate alarm system of claim 2 wherein stop means is fixedly attached to the housing for stopping the lateral movement of said switch activating plate at the gate open position.

4. The gate alarm system of claim 3 wherein a second stop means is fixedly attached to the housing for limiting the lateral movement of said switch activating plate during the gate closed position.

5. The gate alarm system of claim 3 wherein said gate entry means comprises a loop in a rod on said second support and a clasp connected to said second gate end and connectable to said loop in said rod.

6. The gate alarm system of claim 2 wherein said gate entry means comprises a loop in said first shaft end and a clasp connected to said first gate end and connectable to said loop in said first shaft end.

7. The gate alarm system of claim 1 wherein said alarm means is a visual alarm.

8. The gate alarm system of claim 1 wherein said alarm means is an audible alarm.

9. The gate alarm system of claim 8 wherein a deactivating switch is electrically connected between said audible alarm and said power source to deactivate said audible alarm.

10. The gate alarm system of claim 1 wherein said alarm means is a combination of a visual alarm and an audible alarm.

11. The gate alarm system of claim 10 wherein a deactivating switch is electrically connected between said audible alarm and said power source to deactivate said audible alarm.

12. The gate alarm system of claim 1 wherein said gate entry means comprises a clasp and a loop operably connected between said first support and said second support.

13. The gate alarm system of claim 12 wherein said clasp and said loop are operably connected between said first support and said first gate end.

14. The gate alarm system of claim 12 wherein said gate entry means comprises an enclosure having a first enclosure end and a second enclosure end, a threaded rod operably connected to said enclosure having a first rod end connected to said second gate end adjacent to said first enclosure end and extending through said enclosure to a second rod end within said enclosure, a hollow tube having a first tube end and a second tube end extending through said second enclosure end, and a threaded interior for receiving the portion of the threaded rod within said enclosure, a handle connected to said second tube end for unthreading a portion of said tube from said rod to relax said biasing means toward said switch and to permit clearance to unhook said clasp from said loop in the gate open position and for threading a portion of said tube onto said rod to compress said biasing means away from said switch in the gate closed position.

15. The gate alarm system of claim 14 wherein said clasp is connected to said second gate end and said loop is in said first rod end.

16. The gate alarm system of claim 14 wherein a deactivating switch is electrically connected between said alarm means and said power source to deactivate said alarm means.

17. The gate alarm system of claim 1 wherein a deactivating switch is electrically connected between said alarm means and said power source to deactivate said alarm means.

18. The gate alarm system of claim 1 wherein said gate protects personnel from a hazardous situation.

19. The gate alarm system of claim 18 wherein said gate protects personnel from falling from a work platform.

20. The gate alarm system of claim 19 wherein said gate comprises a cable having a plurality of strands of metal wire.

21. The gate alarm system of claim 20 wherein a safety harness is provided for personnel and wherein a safety cable system is provided comprising:

(i) a cable housing capable of being connected to a stationary support and positioned to protect personnel from falling from the work platform when the gate is in the gate open position;

(ii) a length of safety cable having a safety harness end extending from said cable housing and connectable to said safety harness; and (iii) a retraction means for retracting the length of said safety cable to a fully retracted position when not in use and for allowing personnel to retract at least a portion of the length of said safety cable from said cable housing when connecting said safety harness to said safety harness end.

22. The gate alarm system of claim 21 wherein magnetic switch means is operably connected to said retraction means and electrically connected to said alarm means for activating said alarm if said safety cable is in the fully retracted position and said gate is in the gate open position.

23. The gate alarm system of claim 22 wherein said switch within said gate alarm housing is electrically connected to a visual alarm and said magnetic switch means comprises a magnetic switch operably connected to said retraction means and electrically connected to an audible alarm, at least one magnet operably attached to said safety cable adjacent to the safety harness end and connectable to said magnetic switch whereby said audible alarm is deactivated when said gate is in a gate open position and personnel begin to retract said safety cable to break the magnetic connection between said magnet and said magnetic switch.

24. The gate alarm system of claim 1 wherein said gate comprises a cable having a plurality of strands of metal wire.

25. A gate alarm system which comprises:

(a) a gate to protect personnel from falling from a work platform comprising a cable having a first gate end adjacent to a first support and a second gate end adjacent to a second support and extending generally between said first support and said second support during a gate closed position, at least a portion of said cable capable of being positioned to a gate open position and capable of being returned to the gate closed position;

(b) a gate alarm means comprising:

(i) a housing mounted to said first support;

(ii) a switch within said gate alarm housing;

(iii) a switch activating means within said gate alarm housing for activating said switch;

(iv) a biasing means for biasing said switch activating means toward said switch during the gate open position and away from said switch during the gate closed position;

(v) an alarm means operably mounted to said gate alarm housing and electrically connected to said switch for signaling when said gate is in the gate open position; and (vi) a power source for said alarm means and electrically connected to said switch; and (c) gate entry means on said gate for establishing a gate open position to allow biasing of said switch activating means towards said switch and thereby activating said switch.

26. The gate alarm system of claim 25 wherein said housing has a first housing end adjacent to said first gate end, and a second housing end, a pair of sides, a top and a bottom, wherein said switch activating means comprises a switch activating plate, a shaft horizontally extending through said first housing end having a first shaft end connected to said first gate end and a second shaft end connected to said switch activating plate, and wherein said biasing means is a coiled spring encircling said shaft between said switch activating plate and said first housing end for laterally moving said plate within said housing.

27. The gate alarm system of claim 26 wherein stop means is fixedly attached to the housing for stopping the lateral movement of said switch activating plate at the gate open position.

28. The gate alarm system of claim 27 wherein a second stop means is fixedly attached to the housing for limiting the lateral movement of said switch activating plate during the gate closed position.

29. The gate alarm system of claim 25 wherein said alarm means is a visual alarm.

30. The gate alarm system of claim 25 wherein said alarm means is an audible alarm.

31. The gate alarm system of claim 30 wherein a deactivating switch is electrically connected between said audible alarm and said power source to deactivate said audible alarm.

32. The gate alarm system of claim 25 wherein said alarm means is a combination of a visual alarm and an audible alarm.

33. The gate alarm system of claim 32 wherein a switch is electrically connected between said audible alarm and said power source to deactivate said audible alarm.

34. The gate alarm system of claim 25 wherein said gate entry means comprises a clasp connected to second cable end, an enclosure having a first enclosure end and a second enclosure end, a threaded rod operably connected to said enclosure having a first rod end forming a loop connectable to said clasp and extending through said enclosure to a second rod end within said enclosure, a hollow tube having a first tube end and a second tube end extending through said second enclosure end, and a threaded interior for receiving the portion of the threaded rod within said enclosure, a handle connected to said second tube end for unthreading a portion of said tube from said rod to relax said biasing means toward said switch and to permit clearance to unhook said clasp from said loop in the gate open position and for threading a portion of said tube onto said rod to compress said biasing means away from said switch in the gate closed position.

35. The gate alarm system of claim 34 wherein a deactivating switch is electrically connected between said alarm means and said power source to deactivate said alarm means.

36. The gate alarm system of claim 25 wherein a deactivating switch is electrically connected between said alarm means and said power source to deactivate said alarm means.

37. The gate alarm system of claim 25 wherein a safety harness is provided for personnel and wherein a safety cable system is provided comprising:

(i) a cable housing capable of being connected to a stationary support and positioned to protect personnel from falling from the work platform when the gate is in the gate open position;

(ii) a length of safety cable having a safety harness end extending from said cable housing and connectable to said safety harness; and (iii) a retraction means for retracting the length of said safety cable to a fully retracted position when not in use and for allowing personnel to retract at least a portion of the length of said safety cable from said cable housing when connecting said safety harness to said safety harness end.

38. The gate alarm system of claim 37 wherein magnetic switch means is operably connected to said retraction means and electrically connected to said alarm means for activating said alarm if said safety cable is in the fully retracted position and said gate is in the gate open position.

39. The gate alarm system of claim 38 wherein said switch within said gate alarm housing is electrically connected to a visual alarm and said magnetic switch means comprises a magnetic switch operably connected to said retraction means and electrically connected to an audible alarm, at least one magnet operably attached to said safety cable adjacent to the safety harness end and connectable to said magnetic switch whereby said audible alarm is deactivated when said gate is in a gate open position and personnel begin to retract said safety cable to break the magnetic connection between said magnet and said magnetic switch.

* * * * *